United States Patent [19]

Petrovich

[11] 4,098,686

[45] Jul. 4, 1978

[54] FROTH FLOTATION METHOD FOR RECOVERING OF MINERALS

[76] Inventor: Vojislav Petrovich, 1935, W. Schiller St., Chicago, Ill. 60622

[21] Appl. No.: 723,779

[22] Filed: Sep. 16, 1976

Related U.S. Application Data

[62] Division of Ser. No. 668,645, Mar. 19, 1976, abandoned.

[51] Int. Cl.[2] ..... B03D 1/06

[52] U.S. Cl. ..... 209/166; 75/2

[58] Field of Search ..... 75/2; 209/166, 167.9; 260/463; 252/61

[56] References Cited

U.S. PATENT DOCUMENTS

| | | | |
|---|---|---|---|
| 1,775,587 | 9/1930 | Callsen | 260/463 |
| 2,214,352 | 9/1940 | Schoeller et al. | 209/166 |
| 2,635,100 | 4/1953 | Werntz | 260/463 |
| 2,684,381 | 7/1954 | Dial | 260/463 |
| 2,887,452 | 5/1959 | Alpert et al. | 260/463 |
| 2,983,738 | 5/1961 | Stenberg | 252/61 |
| 3,162,664 | 12/1964 | Brotherton et al. | 260/463 |
| 3,268,507 | 8/1966 | Kruckenberg | 260/463 |
| 3,574,183 | 4/1971 | Kruckenberg | 260/463 |
| 3,742,008 | 6/1973 | Krenzer | 260/463 |
| 3,758,527 | 9/1973 | Marxer | 260/463 |
| 3,822,014 | 7/1974 | Verheyden et al. | 209/166 |
| 3,853,751 | 12/1974 | Harris et al. | 209/166 |
| 3,976,565 | 8/1976 | Petrovich | 209/166 |
| 4,043,902 | 8/1977 | Hartjens et al. | 209/166 |

*Primary Examiner*—L. Dewayne Rutledge
*Assistant Examiner*—Michael L. Lewis

[57] ABSTRACT

A froth flotation method for recovering vanadium, molybdenum, wolfram, and uranium minerals over silica, alumino, and ferromagnesian silicates, which comprises; subjecting the comminuted ore of aforesaid metals to froth flotation process in the presence of phosphoric, pyrophosphoric, phosphorous, and hypophosphorous acids and an effective amount of quaternary ammonium hydroxide; molybdenum sulfide ore is oxidized with hydrogen peroxide or the like peroxidizing agents to a higher oxidizing state prior to adding phosphoric acid and the quaternary ammonium hydroxide; the indicated compounds provide selectivity and recovery of metal values of vanadium, molybdenum, wolfram, and uranium.

2 Claims, No Drawings

FROTH FLOTATION METHOD FOR RECOVERING OF MINERALS

This application is divisional application of the application Ser. No. 668,645, filed Mar. 19, 1976, now abandoned.

This invention relates to a method in which a class of stable undissociable complexes which ensue at the mineral surface when quaternary ammonium hydroxides in conjunction with phosphoric, pyrophosphoric, phosphorous, or hypophosphorous acids added to a mineral slurry containing minerals of metals selected from the group of vanadium, molybdenum, wolfram, and uranium. Instead of caustic quaternary ammonium hydroxides and acids, such as phosphoric, pyrophosphoric, phosphorous, and hypophosphorous acids which are strong and corrosive acids, quaternary ammonium phosphate, pyrophosphate, phosphite or hypophosphite may be applied because of safety and safer handling. The complexing ability of enumerated phosphorus acid radicals as radicals of strong acids with said metals in respective minerals depends upon the presence of coordinated alkali metals, which in the respective cases of this invention, the alkali metals are represented by quaternary ammonium strongly positive cations. Thus, the quaternary ammonium radical with the short or the shortest chain length of substituted hydrocarbons which exhibit a strong alkaline reaction may unite with said phosphorus acids and vanadic, molybdic, wolframic, and uranic acids or uranyls of respective minerals selected from the group of heavy metal vanadates, molybdates, wolframates, and uranates-uranyls. To acquire non hydrolyzable and non dissociable complexes at the mineral surface despite of different strength of acidity of said vanadic, molybdic, wolframic, and uranic-uranyl acids bound to the different metals in respective minerals, as well as the various strength of phosphoric, pyrophosphoric, phosphorous, hypophosphorous acids, the quaternary ammonium hydroxides are adjustable by changing the number of carbon atoms in respective substituents, to acquire an exact alkalinity of the same, which yields in conjunction with said phosphorus acids and said mineral acids bound in various minerals, stable undissociable mineral-hydrocarbon complexes.

Quaternary ammonium hydroxides of this invention possess pronounced collecting and frothing properties, adequate to the need in froth flotation processes. Strong frothing properties are provoked by the presence of carbonic group in the alkyl chain attached to the nitrogen atom of said quaternary ammonium hydroxides, thus exhibiting a unique combination of properties including collecting and frothing properties. Said quaternary ammonium bases are active collector-frothers in alkaline as well as in acid pulp of mineral slurry, because the incorporated dialkylcarbonic ester group being neutral does not interfere with the change of pH value, but aid in frothing properties, thus aiding in the levitation of vanadate, molybdate, wolframate, and uranate-uranyl minerals from the mineral slurry.

The special feature of this invention resides in the feasibility of floating molybdenite mineral, molybdenum sulfide, after oxidizing the mineral surface of molybdenite mineral with oxidizing agents selected from the group of hydrogen peroxide and the like peroxides derived from hydrogen peroxide, by which oxidizing action a higher valency of molybdenum is acquired, such as in molybdic acid. This higher valency state exhibiting molybdic acid properties readily reacts with phosphoric acid and quaternary ammonium hydroxide added to the mineral slurry, or added quaternary ammonium phosphate, yielding said mineral-hydrocarbon complexes in the general way of this invention.

The advantage of this invention resides in the fact that no specific frothing agents are to be employed, since the products of this invention develop sufficient froth to be good collectors and frothers at the same time, which adds in the over-all economy and operativity of the process.

The further advantage of this invention resides in the feasibility of recycling the processed water after desliming by cycloning.

A further object of this invention is to provide specific promoters such as hereinbefore said inorganic acids which act only in conjunction with said collectors, the quaternary ammonium hydroxides, thus selectively levitating said mineral values in the floating froth.

And finally as the prime object of this invention is to provide froth-flotation method for recovering of metal values of vanadium, molybdenum, wolfram, and uranium from respective vanadates, molybdates, wolframates, and uranates uranyls from their ores.

THE PREFERRED EMBODIMENTS

Collector-frothers of this invention are quaternary alkyl and alkylaryl ammonium hydroxides of the following generic formula:

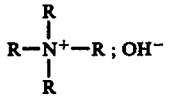

wherein one or two R's are selected from the group of dialkylcarbonate residue of the formula:

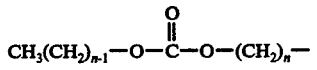

in which $n$ is an integer from 2 to 8; one, two, or three R's are selected from the group of straight or branched alkyl with 1 to 8 carbon atoms; one, two, or three R's selected from the group of phenyl, or substituted phenyl.

The preferred embodiments of froth flotation collector-frothers of this invention with which examples of froth flotation of said metal values are accomplished are the following:

Tributyldibutylcarbonatoammonium hydroxide
Tripropyldihexylcarbonatoammonium hydroxide
Triethyldibutylcarbonatoammonium hydroxide It is evident from the consideration of the above generic formula that the collector-frothers of this invention are quaternary ammonium monobasic bases, wherein the tetraalkyl nitrogen or phenyl/diphenyl-tri/dialkyl nitrogen with it associated anion, the OH group when dissolved and dissociated is positively charged, i.e., comprising the cationic portion of the respective molecule, thus exhibiting the collecting properties either as such or in conjunction with hereinbefore said phosphorus acids against hereinbefore said metallic minerals at the surface contact. Moreover, the cationic portion of the quaternary ammonium monobasic bases comprise the hydrophilic-hydrophobic function in the respective molecule acting thus frothing when the pulp of mineral slurry is agitated in the presence of air.

Because tetraalkyl ammonium bases are strong bases and they are almost caustic bases, which by itself or in conjunction with said mineral acids exert a certain potential towards the mineral surface of said metallic minerals, which interaction results in evolving stable mineral-hydrocarbon complexes.

It is to be noted that said collectors with frothing properties incorporate only one cationic radical per molecule, which is monovalent. Because the said collectors with frothing properties are derived from low molecular weight primary, secondary and tertiary amines by replacing hydrogen atoms by dialkylcarbonate. Said quaternary ammonium hydroxides may be formed unsymetrical which by experience appears preferable, placing the charged nitrogen to the end or near the end of the molecule, which unsymetricity exerts to some higher degree the frothing properties, orienting itself readily at the water-mineral interfaces or water-air interfaces.

BRIEF SUMMARY OF THE INVENTION

The collectors of this invention which function by chemical reaction with the ore in conjunction with the promoter, the said phosphorus acids, exert presumably complexing ability with the metal or metal acid at the mineral surface or portion of the mineral surface of the mineral particle of the ore treated. It is obvious that the polar part, i.e., the complexing groups, i.e., the positively charged nitrogen of the collector and the negatively charged acid radical of respective mineral acid acting as promoter are both oriented inwards to the ore particle, while the alkyl/dialkylcarbonate part of the collector is oriented outward from said particle. Thus, the attachment of said organic complexing ingredient to the mineral particles forms a water repellent surface, or barrier, around at least a part of the surface of the mineral particle and thereby facilitates the formation of the froth when the mineral slurry is agitated in the presence of air.

To illustrate the invention several Examples of the recovery of vanadates, molybdate, oxidized molybdenite, wolframates and uranate-uranyls minerals are accomplished by the conjunctive action of said quaternary ammonium polyalkyl-dialkylcarbonato hydroxides and phosphoric, pyrophosphoric, phosphorous, hypophosphorous acids.

Froth flotation investigations with ores containing vanadates, molybdates, molybdenite, wolframates, uranates, and uranyls, as well as with oxidized molybdenite were accomplished with said quaternary ammonium hydroxides because the exact dosage of needed increments was controlled by controlling the pH. An alkaline pulp of the mineral slurry points to the overdosage of used collector. An acid pulp of mineral slurry points to the overdosage of said phosphorous acids. The overdosage of both reagents, but showing a neutral reaction may be corrected by automatic titration either of quaternary ammonium base or the respective phosphorus acid, and recovered by recycling of processed water. The processed water because of the presence of unspent compounded reagents is a ready made reagentized water for actiion with a certain amount of new mineral slurry. Such a possibility makes feasible automatic control of all reagents present in the pulp of mineral slurry of the flotation process of this invention by automatic titration in combination with electrode ion meter. Thus, there will be no wasting of chemicals, said flotation reagents, also there will be no pollution of environment waters with spent water which will be free of used chemicals.

In connection with the said it must be noted that the mineral-hydrocarbon complexes of this invention are unstable in an alkaline pulp of mineral slurry, which is manifested by lower recoveries of respective minerals. Said complexes are quite stable in an acid pulp of mineral slurry. Therefore, if the working pH is to be 5.0 which depends of the ore treated and the choice of the operator, said pH is to maintain by controlled and automatic inflow of one of the said and working phosphorus acids. All measurement of spent chemicals are to be count about said pH 5.0 as the "neutral point" so to speak. Such low acidity of the pulp of mineral slurry yields recoveries of respective minerals as high as working in an neutral pulp of mineral slurry.

It is to be understood that said quaternary ammonium bases must exert a variety of basicity because the acidity of vanadates, molybdates, wolframates, uranates and uranyls are by itself different. The basicity of the quaternary ammonium bases of this invention depend from the number of carbonic groups which are by itself acidic, as well as from the chain length of substituted alkyls, i.e., from the number of carbon atoms of the entire compound which by itself exerts the electromeric effect. The carbonic group in substituted part of hydrocarbon chain which is limited to eight carbon atoms in one R, exerts frothing properties, thus representing the frothing mass, which is the second main aspect of this invention. It will be noted that with the increasing of the frothing mass, the molecule of said quaternary ammonium bases tend to become less basic, thus tending to alter its interface modifying properties against said phosphorous acids and the respective mineral surface. A proper balance must struck between the frothing mass, the charged nitrogen, and the charged phosphorous acid radical, and presumably charged or to be charged vanadate, molybdate, wolframate, and uranate-uranyl at the mineral surface in order to obtain the maximum interface modifying potency, which is manifested to adequate collecting power and high recovery. Therefore, the applicant cannot restrict himself to the specific details of described constitution of said quaternary ammonium bases. It will be understood that modifications may be made in the constitution of said quaternary ammonium bases as is discussed hereinbefore. Moreover, and in the same way, the scheduled phosphorus acids having extremely different acidity from very low to very high, so the quaternary ammonium bases must exert also a high variety of basicity to satisfy the maximum interface modifying potency in conjunction with the inherent basicity or acidity of respective minerals, thence the high versatility of this invention.

The procedure in performing the laboratory examples for ores containing vandates, molybdates, molybdenite, and wolframates was of the same manipulation as follows: for scheelite, wolframite, and carnotite 500 grams of the ore feed was sized to pass 120 mesh standard sieve. Transferring the sized flotation feed in the flotation machine, various amounts of said quaternary ammonium hydroxides and phosphorus acids for collecting purposes were added. Sodium silicate was added as dispersant of silicates despite that said collectors and promoters in conjunctive action are highly selective and specific for vanadates, molybdates, and wolframates. After the addition of the reagents the pulp of mineral slurry was conditioned for 5 minutes. The amounts of added reagents are indicated in the accompanying table. The rougher concentrates were skimmed from 5 to 10 minutes and afterwards cleaned with processed water.

The flotation of molybdenite was accomplished in the way as follows: 500 grams of molybdenite ore was sized to pass 100 mesh sieve. Transferring the sized flotation feed into flotation machine, hydrogen peroxide and phosphoric acid were added for oxidizing the surface of $Mo^{4+}$ to $Mo^{6+}$ superficially only. Thus, presumably $MoO_3$ or $MoS_2^{2+}$ was formed. To accomplish the oxidation of the mineral slurry, said slurry was conditioned for 5 minutes. After this step, one of the quaternary ammonium base was added, and conditioned for another 5 minutes. Finally a small amount of sodium silicate was added to disperse the silicates, also a small amount of potassium cyanide and lime were added to depress sulfides. After this step the pulp of mineral slurry was aerated. The rougher concentrate was skimmed for 7 minutes. Because of low percentage of present molybdenite in the ore, five identical rougher concentrates were mixed and processed with fresh water. Several drops of said quaternary ammonium base and phosphoric acid were added to prevent the decomposition of mineral-hydrocarbon complex, and to attain the maximum yield and minimum loss of floated molybdenite.

tion of the reagents at the beginning of the operation. On the other hand it is sometimes advantageous to use stage addition of reagents. Pulp densities are in general the same as in other applications of froth flotation practice, i.e., about 15 to 30 per cent of solids by weight.

Also, the use of varying amounts of froth modifiers, dispersants and depressants, in different stages may be used to advantage to obtain the highest yield and best separation.

Having disclosed my invention in detail, which I mentioned hereinabove very short, as well as the feasible application in the use of the same, it is therefore obvious that I do not restrict myself to the specific details of the use described here. It will be understood that modifications may be made in the applications of preferred embodiments of this invention described herein without departing from the scope defined by the appended claims, and in this way broaden the use of the invention as claimed to the other metals in respective minerals under adequate conditions, which will not be out of the scope defined by the appended claims, for, the quaternary ammonium bases of this invention in conjunction with phosphorus acids or metal acids and metal peroxy acids yield floatable mineral-hydrocarbon complexes of various metals not mentioned here and in the appended claims may on the whole contribute that the processes are unexpectedly operative on a broader scale.

It is to be understood that the foregoing detailed discussion is for the purpose of illustration only, and it is

| Ore treated | Phosphoric acid kg per ton | Collector kg per ton | Assay of products Feed % | Conc. % | Recovery % |
|---|---|---|---|---|---|
| Example 1 | 0.1 | Tributyldibutylcarbonato-ammonium hydroxide | $V_2O_5$ | $V_2O_5$ | $V_2O_5$ |
| Carnotite | | 0.3 | the yellow conc. was not analysed | | |
| Example 2 | | Tributyldibutylcarbonato-ammonium hydroxide | $WO_3$ | $WO_3$ | $WO_3$ |
| Scheelite | 0.2 | 0.25 | 2.76 | 73.2 | 93.0 |
| Example 3 | | Tributyldibutylammonium-ammonium hydroxide | $WO_3$ | $WO_3$ | $WO_3$ |
| Wolframite | 0.2 | 0.20 | 1.84 | 70.6 | 94.0 |
| Example 4 | 0.1 $H_2O_2$ | Tripropyldihexylcarbonato-ammonium hydroxide | Mo | Mo | Mo |
| Molybdenite | 0.1 | 0.25 | 0.62 | 52.2 | 91.0 |
| Example 5 | Phosphorous acid | Tripropyldihexylcarbonato-ammonium hydroxide | the yellow conc. was not analysed | | |
| Carnotite | 0.2 | 0.30 | | | |
| Example 6 | Hypophosphorous acid | Triethyldibutylcarbonato-ammonium hydroxide | | $WO_3$ | $WO_3$ |
| Scheelite | 0.2 | 0.25 | 2.74 | 75.4 | 88.0 |
| Example 7 | Pyrophosphoric acid | Tripropyldibutylcarbonato-ammonium hydroxide | the yellow conc. was not analysed | | |
| Carnotite | 0.2 | 0.25 | | | |

The flotation of carnotite with phosphorous and pyrophosphoric acids was accomplished to achieve the flotation of uranyl in the said carnotite, thus generalizing the feasibility of flotation of uranyl minerals with phosphorous or pyrophosphoric acids as promoters in conjunction with quaternary ammonium hydroxides as collectors in a neutral or slightly acid pulp or mineral slurry.

The froth flotation of the present invention is carried out in accordance with good flotation practice and usually, though not always, involves flotation in rougher cells, followed by one or several cleanings of the rougher concentrate. The reagents are effective in small amount and are completely exhausted which enhance the overall economy of the process. The promotion is sufficiently persistant so that it is feasible to carry out the rougher and cleaner flotation with a single addinot intended as being limited to the spirit or scope of the appended claims. While I have gone into considerable detail in explaining my invention, the scope thereof is not to be restricted except by the appended claims.

What I claim as new and desire to protect by Letters Patent of the United States is:

1. A method of beneficiating ores selected from the group of vanadates, molybdates, wolframates, and uranates-uranyls by froth flotation process to produce a froth concentrate of desired metal values which comprises; effecting froth flotation of said ores in the presence of phosphorous acids selected from phosphoric acid, pyrophosphoric acid, phosphorous acid, and hypophosphorous acid, and collectors consisting of quaternary ammonium hydroxide of the generic formula

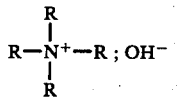

wherein one or two R's consist of dialkylcarbonate of the formula

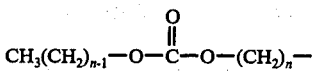

wherein $n$ is an integer from 2 to 8, and one two, or three R's consist of straight or branched hydrocarbon chain with 1 to 8 carbon atoms, or one or two R's consist of phenyl or substituted phenyl; said quaternary ammonium hydroxides acting as collector-frothers in conjunction with said phosphorus acids added to the mineral slurry; said quaternary ammonium hydroxides and said phosphorus acids are added to the mineral slurry as quaternary ammonium phosphate, pyrophosphate, phosphite, or hypophosphite; said quaternary ammonium bases and phosphorus acids acting in conjunction forming at the mineral surface of said vanadates, molybdates, wolframates, and uranates-uranyls mineral-hydrocarbon complexes; said complexes attaching to bubbles provided by agitating the pulp of mineral slurry; and recovering a froth concentrate relatively rich in the desired metal value leaving tailing relatively poor in desired metal value.

2. A method of beneficiating molybdenite mineral by froth flotation process to produce a froth concentrate of molybdenite value which comprises; prior to the addition of phosphoric acid and quaternary ammonium hydroxide, or quaternary ammonium phosphate, an oxidizing action at the mineral surface of molybdenite by hydrogen peroxide or peroxides derived from hydrogen peroxide is effected; effecting froth flotation of molybdenite ore in the presence of phosphoric acid and collector consisting of quaternary ammonium hydroxide of the generic formula

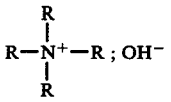

wherein one or two R's consist of dialkylcarbonate of the formula

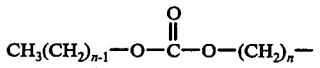

wherein $n$ is an integer from 2 to 8, and one, two, or three R's consist of straight or branched hydrocarbon chain with 1 to 8 carbon atoms, or one, or two R's consist of phenyl or substituted phenyl; said quaternary ammonium hydroxides and phosphoric acid acting in conjunction at the molybdenite surface forming mineral-hydrocarbon complexes; said complexes attaching to bubbles provided by agitating the pulp of mineral slurry; and recovering a froth concentrate relatively rich in molybdenite value, leaving tailing relatively poor in molybdenite value.

* * * * *